US011837389B2

(12) United States Patent
Landa et al.

(10) Patent No.: US 11,837,389 B2
(45) Date of Patent: Dec. 5, 2023

(54) $YCO_5$-BASED COMPOUNDS DOPED WITH FE AND NI FOR HIGH-PERFORMANCE PERMANENT MAGNETS

(71) Applicant: Lawrence Livermore National Security, LLC, Livermore, CA (US)

(72) Inventors: Alexander Landa, Livermore, CA (US); Per Soderlind, Oakland, CA (US); Emily Moore, Livermore, CA (US); Aurelien Perron, Pleasanton, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

(21) Appl. No.: 17/398,905

(22) Filed: Aug. 10, 2021

(65) Prior Publication Data

US 2021/0375511 A1 Dec. 2, 2021

Related U.S. Application Data

(63) Continuation-in-part of application No. 16/478,807, filed as application No. PCT/US2018/014040 on Jan. 17, 2018.

(60) Provisional application No. 62/447,373, filed on Jan. 17, 2017.

(51) Int. Cl.
*H01F 1/047* (2006.01)
*C22C 30/00* (2006.01)

(52) U.S. Cl.
CPC ..... *H01F 1/047* (2013.01); *C22C 30/00* (2013.01); *C22C 2202/02* (2013.01)

(58) Field of Classification Search
None
See application file for complete search history.

(56) References Cited

U.S. PATENT DOCUMENTS

| | | | |
|---|---|---|---|
| 4,378,258 | A | 3/1983 | Clark et al. |
| 2004/0244876 | A1 | 12/2004 | Konishi et al. |
| 2020/0318222 | A1 | 10/2020 | Landa et al. |

FOREIGN PATENT DOCUMENTS

| | | | |
|---|---|---|---|
| CA | 918045 | A | 1/1973 |

OTHER PUBLICATIONS

Non-Final Office Action from U.S. Appl. No. 16/478,807, dated Oct. 8, 2021.
Grace Period Disclosure, "Thermodynamics and Magnetism of YCo5 Compound Doped with Fe and Ni: An Ab Initio Study," Alexander Landa, Per Söderlind, Emily E. Moore, Aurelien Perron, Aug. 31, 2020, 21 pages.
Soderlind et al., "Prediction of the new efficient permanent magnet SmCoNiFe3," Physical Review B 96, 2017, pp. 100401-1-100401-5.
Landa et al., "Thermodynamics of SmCo5 compound doped with Fe and Ni: An ab initio study," Journal of Alloys and Compounds, vol. 765, 2018, pp. 659-663.
Landa et al., "Thermodynamics and Magnetism of YCo5 Compound Doped with Fe and Ni: An Ab Initio Study," Applied Sciences, vol. 10, 2020, pp. 1-21.
(Continued)

*Primary Examiner* — Brian D Walck
(74) *Attorney, Agent, or Firm* — Zilka-Kotab, P.C.

(57) ABSTRACT

In accordance with one aspect of the presently disclosed inventive concepts, a magnet includes a material having a chemical formula: $YFe_3(Ni_{1-x}Co_x)_2$, where x is greater than 0 and x is less than 1.

17 Claims, 4 Drawing Sheets

(56) References Cited

OTHER PUBLICATIONS

Gavrikov et al., "Effect of Ni doping on stabilization of Sm(Co1?xFex)5 compound: thermodynamic calculation and experiment," Journal of Physics: Condensed Matter, vol. 32, 2020, pp. 1-7.
Coey, J.D.M., "Magnetic Materials for Green Innovation," Presentation, TMS San Diego, 2014, 50 pages.
Coey, J.D.M., "Hard Magnetic Materials: A Perspective," IEEE Transactions on Magnetics, vol. 47, No. 12, Dec. 2011, pp. 4671-4681.
Coey, J.D.M., "Permanent magnets: Plugging the gap," Scripta Materialia, vol. 67, 2012, pp. 524-539.
Paige et al., "The Magnetocrystalline Anisotropy of Cobalt," Journal of Magnetism and Magnetic Materials, vol. 44, 1984, pp. 239-248.
Ermolenko et al., "Giant coercive force and certain features in the magnetization reversal of bulky single crystals of the intermetallic compounds Sm(C01-xNix)s," JETP Letters, vol. 21, No. 1, Jan. 5, 1075, 2 pages.
Liu et al., "Handbook of Advanced Magnetic Materials, vol. I: Advanced Magnetic Materials: Nanostructural Effects" Springer Science+Business Media, Inc., 2006, 47 pages.
Coey, J.D.M., "Magnetism and Magnetic Materials," Cambridge University Press, 2009, 633 pages.
Miyazaki et al., "Formation and Magnetic Properties of Metastable (TM)5Sm and (TM)7Sm2 (TM=Fe,Co) Compounds," Journal of Magnetism and Magnetic Materials, vol. 75, 1988, pp. 123-129.
Miyazaki et al., "Formation of metastable compounds and magnetic properties in rapidly quenched (Fe1?x Cox)5Sm and (Fe1?xCox)7Sm2 alloy systems," Journal of Applied Physics, vol. 64, No. 10, Nov. 15, 1988, pp. 5974-5976.
Larson et al., "Calculation of magnetic anisotropy energy in SmCo5," Physical Review B, vol. 67, 2003, pp. 214405-1-214405-6.
Laforest et al., "Neutron Diffraction Study of the Th (Co1-xFex)5 Alloys," IEEE Transactions on Magnetics, Sep. 1973, pp. 217-220.
Liu et al., "Magnetic moments and exchange interaction in Sm(Co,Fe)5 from first-principles, Computational Materials Science," Computational Materials Science, vol. 50, 2011, pp. 841-846.
Guo et al., "Standard Enthalpies of Formation for some Samarium Alloys, Sm+Me (Me=Ni, Rh, Pd, Pt), Determined by High-Temperature Direct Synthesis Calorimetry," Metallurgical and Materials Transactions B, vol. 29B, Aug. 1998, pp. 815-820.
Liu et al., "Effect of Fe partial substitution for Co on the magnetic properties of Y(Co,Fe)5 from first-principles," Journal of Applied Physics, vol. 107, 2010, pp. 09A718-1-09A718-3.
Meyer-Liautaud et al., "Enthalpies of Formation of Sm—Co Alloys in the Composition Range 10-22 at. %Sm," Journal of the Less-Common Metals, vol. 127, 1987, pp. 243-250.
Rosner et al., "Magneto-elastic lattice collapse in YCo5," Nature Physics Letters, vol. 2, Jul. 2006, pp. 469-472.
Nouri et al., "The isothermal section phase diagram of the Sm—Fe—Ni ternary system at 800° C.," Journal of Alloys and Compounds, vol. 661, 2016, pp. 508-515.
Tie-Song et al., "Magnetic properties of R ions in RCo5 compounds (R=Pr, Nd, Sm, Gd, Tb, Dy, Ho, and Er)," Physical Review B, vol. 43, No. 10, Apr. 1, 1991, pp. 8593-8598.
Streever, R.L., "Individual Co site contributions to the magnetic anisotropy of RCo5 compounds and related structures," Physical Review B, vol. 19, No. 5, Mar. 1, 1979, pp. 2704-2711.
Givord et al., "Temperature dependence of the samarium magnetic form factor in SmCo5," Journal of Applied Physics, vol. 50, No. 3, Mar. 1979, pp. 2008-2010.
Heidemann et al., "Investigation of the Hyperfine Fields in the Compounds LaCo13, LaCo5, YCo5 and ThCo5 by Means of Inelastic Neutron Scattering," Z. Physik B, vol. 22, 1975, pp. 367-372.
Alameda et al., "Large Magnetization Anistrophy in Uniaxial YCo5 Intermetallic," Journal of Magnetism and Magnetic Materials, 1980, pp. 1257-1258.
Schweizer et al., "Polarised neutron study of the RCo5 intermetallic compounds. I. The cobalt magnetisation in YCo5," Journal of Physics F: Metal Physics, vol. 10, 1980, pp. 2799-2817.
Niarchos, D., "'Artificial Multi-Elements' based on High Entropy Alloys as 'building blocks' for novel magnetic alloys suitable for Permanent Magnets: Special cases ThMn12 and SmFe3CoNi," The European Conference Physics of Magnetism (PM'21), 2021, 2 pages, retrieved from https://www.ifmpan.poznan.pl/pm21/invited-speakers.html.
International Search Report and Written Opinion from PCT Application No. PCT/US2018/014040, dated Mar. 26, 2018.
Landa et al., "Thermodynamics of the Doped Sm(Co1-XFeX)5 Alloys: Ab Initio Study," AVS 63rd International Symposium & Exhibition, May 9, 2016, 2 pages (abstract only).
Miyazaki et al., "Formation of Compounds and Their Magnetic Properties of Rapidly Quenched (Fe1-x Cox)4.5(Ni,Al) 0.5 Sm Alloys," IEEE Translation Journal on Magnetics in Japan, vol. 6, No. 10, Oct. 1991, pp. 908-913.
Lamichanne et al., "Magnetic Properties Hard-Soft SmCo5—FeNi and SmCo5—FeCo Composites Prepared by Electroless Coating Technique," Open Journal of Composite Materials, No. 2, Oct. 2012, pp. 119-124.
Laforest et al., "Neutron Diffraction Study of the Th (col-xFex)5 Alloys," IEEE Transactions on Magnetics, vol. MAG-9, No. 3, Sep. 1973, pp. 217-220.
Nouri et al., "The isothermal section phase diagram of the Sm—Fe—Ni ternary system at 800 oC," Journal of Alloys and Compounds vol. 661, 2016, pp. 508-515.
Liu et al., "Magnetic moments and exchange interaction in Sm(Co,Fe)5 from first-principles," Computational Materials Science, vol. 50, 2011, pp. 841-846.
International Preliminary Examination Report from PCT Application No. PCT/US2018/014040, dated Aug. 1, 2019.
Landa et al., U.S. Appl. No. 16/478,807, filed Jul. 17, 2019.
Turchi et al., "Ab initio-aided Thermodynamics of Rare Earth-based Alloys," Abstracts of MS&T, Oct. 2016, 2 pages (abstract only).
Landa et al., "Thermodynamics of Sm(Co1-xFex)5 Alloys Doped with Ni: Ab Initio Study: Project 2.1.6," Presentation from Critical Materials Institute 4th Annual Meeting (CMI), Aug. 18, 2016, 17 pages.
Landa et al., "Thermodynamics of Sm(Co1-xFex)5 Alloys Doped with Ni: Ab Initio Study," AVS 63nd International Symposium & Exhibition, Presentation, Nov. 6-11, 2016, 24 pages.
Landa et al., "Thermodynamics of the SmCo5 Compound Doped with Fe and Ni: An AB Initio Study," arXiv, Lawrence ivermore National Laboratory, Dec. 13, 2016, 23 pages, retrieved from https://arxiv.org/abs/1707.09447.
Soderlind et al., "Prediction of the new efficient permanent magnet SmCoNiFe3," Americal Physical Society, Physical Review B, vol. 96, 2017, pp. 100404:1-100404:5.
Perron et al., "Impact of MDS on materials design Update on hard magnet studies," Lawrence Livermore National aboratory, Presented at CMI Annual Meeting, Aug. 29-31, 2017, 1 page, retrieved from https://cmi.ameslab.gov/2017-annual-meeting.
Daene et al., "Study of 1:5-Type Rare Earth Magnets and Compounds," Critical Materials Institute, Presented at CMI Annual Meeting, Aug. 29-31, 2017, 1 page, retrieved from https://cmi.ameslab.gov/2017-annual-meeting.
Landa et al., "Thermodynamics of the SmCo5 and Magnet Doped with Fe and Ni: AB Initio Study," Euromat, Jan. 19, 2017, 2 pages, (abstract only).
Landa et al., "Thermodynamics of SmCo5 Magnet Doped with Fe and Ni: Ab Initio Study," Lawrence Livermore National Laboratory, Presentation from European Congress and Exhibition on Advanced Materials and Processes (EUROMAT), Sep. 17-22, 2017, 20 pages.
Landa et al., "Thermodynamics of SmCo5 compound doped with Fe and Ni: An ab initio study," Journal of Alloys and Compounds, vol. 765, Jun. 23, 2018, pp. 659-663.
Turchi et al., "Application of Thermodynamics to Rare Earth-Based Alloy Design," TMS 146th Annual Meeting and Exhibition, Jul. 29, 2016, 2 pages (abstract only).
Turchi et al., "Efficient Prototyping of Rare Earth-based Alloys from Ab Initio Electronic Structure and Thermodynamics: Ab Initio-

(56) References Cited

OTHER PUBLICATIONS aided Thermodynamics of Complex Multi-component Alloys," Critical Materials Institute, Presentation, Aug. 16-18, 2016, 12 pages.
Final Office Action from U.S. Appl. No. 16/478,807, dated Feb. 10, 2022.
Turchi et al., "Ab Initio-aided Thermodynamics of Rare Earth-based Alloys," MS&T '16, Presentation, Oct. 23-27, 2016, pp. 1-44.
Turchi et al., "Advanced Theoretical Screening of Multi-component Alloys," Japan-US Bilateral 4th Meeting on Rare Metals, Presentation, Nov. 7, 2016, pp. 1-17.
Niarchos et al., "Artificial Multi-Elements"based on High Entropy Alloys as "building blocks" for novel magnetic alloys suitable for Permanent Magnets: Special cases ThMn12 and SmFe3CoNi, "abstract presented at the European Conference" Physics of Magnetism 2021 (PM '21), Poznan, Poland, Jun. 28-Jul. 2, 2021, 2 pages.
Restriction Requirement from U.S. Appl. No. 16/478,807, dated Jun. 29, 2021.
Examiner's Answer to Appeal Brief from U.S. Appl. No. 16/478,807, dated Sep. 22, 2022.

$YCo_5$-BASED COMPOUNDS DOPED WITH FE AND NI FOR HIGH-PERFORMANCE PERMANENT MAGNETS

RELATED APPLICATIONS

This application is a Continuation in Part of U.S. Non-Provisional patent application Ser. No. 16/478,807 filed Jul. 17, 2019, which is a National Stage Entry of PCT/US2018/014040 filed Jan. 17, 2018, that claims priority to U.S. Provisional Application No. 62/447,373 filed Jan. 17, 2017, all of which are herein incorporated by reference.

This invention was made with Government support under Contract No. DE-AC52-07NA27344 awarded by the United States Department of Energy. The Government has certain rights in the invention.

FIELD OF THE INVENTION

The present invention relates permanent magnets, and more particularly, this invention relates to $YCo_5$-based magnets.

BACKGROUND

Among the great challenges of materials science is discovering a material that satisfies conflicting requirements and also possesses specific properties for a particular application. There is a need for strong permanent magnets to withstand higher temperatures, for example Curie temperatures ranging from 800 K to 1200 K, which the widely used neodymium-based magnets ($Nd_2Fe_{14}B$, Neomax®) cannot tolerate. Pure Samarium-Cobalt (SmCo) magnets (both $SmCo_5$ and $Sm_2Co_{17}$) satisfy this requirement and are less subject to corrosion than the neodymium-based magnets and thus do not require a coating. Moreover, pure SmCo magnets have strong resistance to demagnetization.

Three basic material parameters determine the intrinsic properties of hard magnetic materials: (i) spontaneous (saturation) magnetization, ($M_s$), (ii) Curie temperature ($T_c$), and (iii) magnetocrystalline anisotropy energy (MAE). An optimal technological permanent magnet has a large spontaneous magnetization ($M_s \geq \sim 1$ MA), high Curie temperature ($T_c \geq \sim 550$ K), and large MAE constant ($K_1 \geq \sim 4$ MJ/m$^3$).

Pure $YCo_5$ permanent magnets exhibit high uniaxial MAE constant of $K_1 \sim 6.5$ MJ/m$^3$, which is excessive compared to that of $Nd_2Fe_{14}B$ magnets having MAE with a $K_1$ of ~4.9 MJ/m$^3$. $YCo_5$ permanent magnets have high Curie temperature, $T_c \sim 987$ K, which is almost twice that of $Nd_2Fe_{14}B$ magnets having Curie temperature, $T_c \sim 588$ K. However, the $Nd_2Fe_{14}B$ magnet currently dominates the world market for permanent magnets (~62% of world market), since the $Nd_2Fe_{14}B$ magnet has large spontaneous magnetization and possesses the highest energy performance measured by a record high energy product. The Maximum Energy Product $(BH)_{max}$ of the $Nd_2Fe_{14}B$ magnet at 512 kJ/m$^3$ is more than twice as high as the $(BH)_{max}$ of $YCo_5$ magnets, at 224 kJ/m$^3$.

It would be desirable to formulate a permanent magnet with a greater spontaneous magnetization, high MAE and thermostability comparable to $YCo_5$ magnets while having a high Curie temperature.

SUMMARY

In accordance with one aspect of the presently disclosed inventive concepts, a magnet includes a material having a chemical formula: $YFe_3(Ni_{1-x}Co_x)_2$, where x is greater than 0 and x is less than 1.

In accordance with another aspect of the presently disclosed inventive concepts, a magnet includes a material having a chemical formula: $YFe_3(Ni_{1-x}Co_x)_2$, where x is greater than 0 and x is less than 1, and where the material has a $CuCa_5$-type crystal structure.

Other aspects and advantages of the present invention will become apparent from the following detailed description, which, when taken in conjunction with the drawings, illustrate by way of example the principles of the invention.

DETAILED DESCRIPTION

Figure 1:
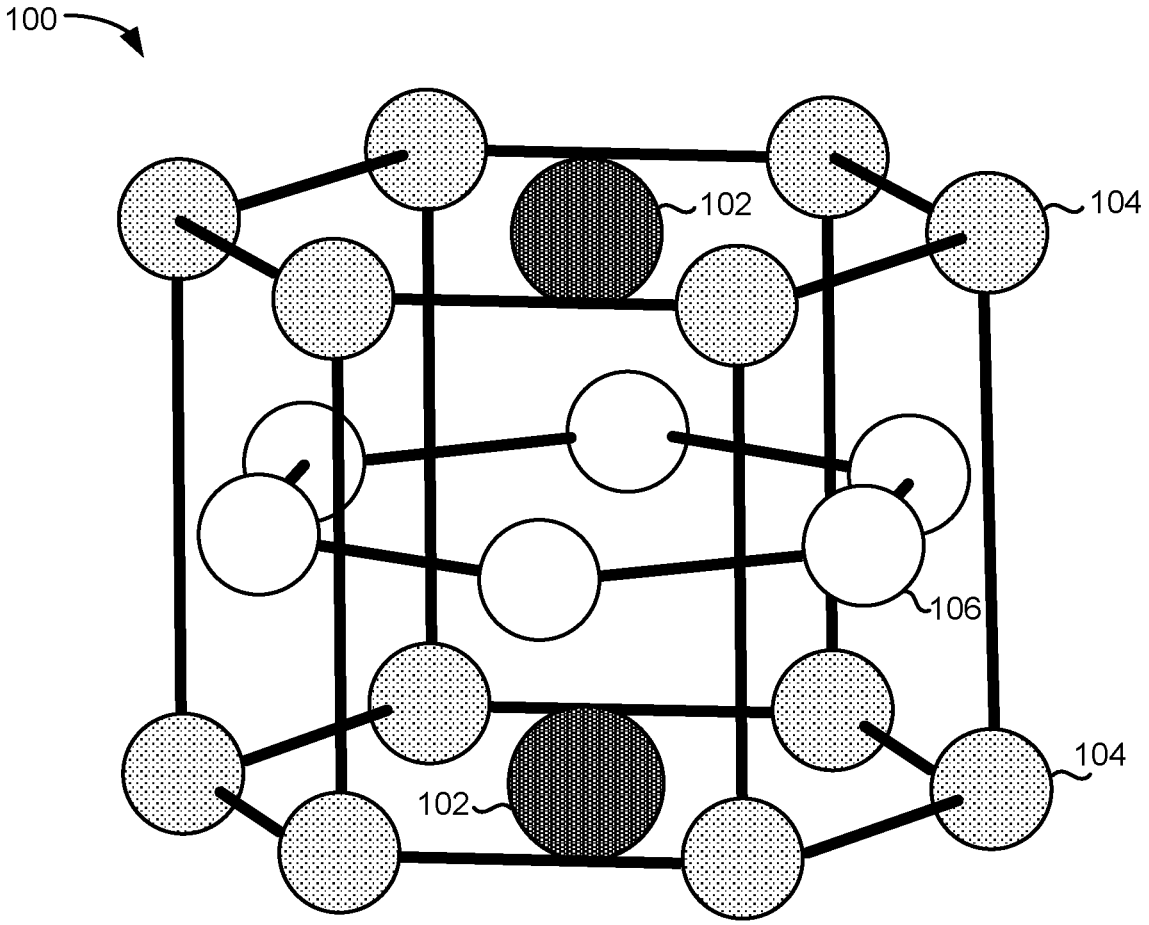
FIG. 1 is a schematic drawing of a crystal structure ($CaCu_5$-type) of a $YCo_5$ compound, according to inventive concepts described.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

The term "dopant" as used in the instant descriptions shall be understood to encompass any element or compound that is included in a host medium material, so as to convey a particular functional characteristic or property on the resulting structure. In most cases, the dopant will be incorporated into a crystal structure of the host medium material.

In accordance with one general aspect of the presently disclosed inventive concepts, a magnet includes a material having a chemical formula: $YFe_3(Ni_{1-x}Co_x)_2$, where x is greater than 0 and x is less than 1.

In accordance with another general aspect of the presently disclosed inventive concepts, a magnet includes a material having a chemical formula: $YFe_3(Ni_{1-x}Co_x)_2$, where x is greater than 0 and x is less than 1, and where the material has a $CuCa_5$-type crystal structure.

A list of acronyms used in the description is provided below.

Å angstrom
at % atomic percent
$(BH)_{max}$ Maximum Energy Product
Co Cobalt
DFT Density functional theory LDA Local density approximation
GGA General gradient approximation
EF Fermi level
Fe Iron
GPa gigapascal
K Kelvin, $T_c$ temperature
$K_1$ Magnetocrystalline anisotropy energy constant
kJ kilojoules
m meters
MA mega amperes
meV milli-electronvolts
MJ megajoules
MAE Magnetocrystalline anisotropy energy
DLM Disordered local moment
AF Antiparallel fashion
FREMTO Fully relativistic exact muffin-tin orbital
CPA Coherent potential approximation
FPLMTO Full-potential linear muffin-tin orbital method
$m^{(tot)}$ total moment
$m^{(s)}$ spin magnetic moment
$m^{(o)}$ orbital magnetic moment
$M_s$ spontaneous magnetization
Nd Neodymium
Ni Nickel
Ca Calcium
Cu Copper
RE Rare earth metal
Sm Samarium
Y Yttrium
$T_c$ Curie temperature
TM Transition-Metal
$\mu_B$ Bohr magneton According to various inventive concepts described herein, a permanent magnet may be formed that has a high spontaneous magnetization, thermostability, high Curie temperatures and high magnetocrystalline anisotropy energy (MAE). Ideally, transition-metal dopants may boost the energy product of $YCo_5$ magnets without compromising the high MAE and high Curie temperatures of these magnets. For example, combining transition-metal (TM) with rare-earth-metal (RE) atoms in various intermetallic compounds may result in material in which RE and TM atoms induce a large magnetic anisotropy and provide a large magnetization and high Curie temperature.

Iron (Fe) is more readily available than cobalt (Co) such that Fe is ~2000 times more abundant in the Earth's crust than Co. Thus, at least from a cost standpoint, it would be beneficial to substitute Co atoms in $YCo_5$ with Fe atoms since the relative abundance of available Fe could result in a less expensive component. In addition, Fe may be desirable as an added component to a magnet material since its ferromagnetic metal properties have a large magnetization at room temperature (1.76 MA/m).

FIG. 1 depicts a structure 100 of a material of a magnet, in accordance with inventive concepts described herein. As an option, the present structure 100 may be implemented in conjunction with features from any other inventive concepts listed herein, such as those described with reference to the other FIGS. Of course, however, such structure 100 and others presented herein may be used in various applications and/or in permutations which may or may not be specifically described in the illustrative concepts listed herein. Further, the structure 100 presented herein may be used in any desired environment.

As shown in FIG. 1, the crystal structure of a $CaCu_5$ ($D_{2d}$)-type Structure 100 with three distinct atoms displayed, may represent a $YCo_5$ compound crystal structure in accordance with some approaches. An yttrium atom ($Y_1$) may be in the Wyckoff position 1a 102 centered in a plane with two $Co_1$ atoms in the position 2c 104 surrounding the $Y_1$ in the position 1a 102 and a second layer with three more $Co_2$ atoms in the position 3g 106 for a total of six atoms in the unit cell. Bonding and energy between the atoms of a crystal structure may be defined by the interactions between 3d-orbital electrons of the transition metals in the position 2c 104 or position 3g 106 and the 5d-orbital electrons from yttrium ($Y_1$) in the center position 1a 102 as shown in FIG. 1.

In the $YFe_5$ compound that only includes Fe atoms without any Co atoms, the instability of the crystal structure may be related to a decrease in the number of 3d electrons in the electronic structure. Indeed, crystal stabilities of the magnetic 3d transition metals may be governed by the number of 3d electrons.

Thus, substituting all cobalt atoms with a transition metal with higher magnetic moment, such as iron, in order to optimize the maximum energy product (i.e., $YCo_5 \rightarrow YFe_5$) may result in a thermodynamically unstable crystal structure of an ordinary hexagonal phase. Moreover, $YFe_5$ does not appear in the equilibrium Y—Fe phase diagram, although the alloy compound $Y(Co_{1-x}Fe_x)_5$ with $CaCu_5$-type structure has been synthesized for x=0.2 to 0.4.

For synthesized $Y(Co_{1-x}Fe_x)_5$ materials, the Curie temperatures ($T_c$) for $Y(Co_{1-x}Fe_x)_5$ alloys were found to increase from about 930 K to about 1020 K when increasing x from 0.0 to 0.2. In contrast, $Y_2(Co_{1-x}Fe_x)_{17}$ alloys exhibit a monotonic decrease in Curie temperature ($T_c$) with increasing Fe content. The orbital moment of cobalt is larger compared to iron, and a decrease of the MAE occurs for x>0. The lattice constant and magnetization are enhanced for x=0 to 0.4 in $Y(Co_{1-x}Fe_x)_5$ alloys.

Accordingly, the inventive concepts presented herein, in several embodiments, involve ab initio calculations to add nickel (Ni) and iron (Fe) to a $YCo_5$ magnet in order to stabilize $Y(Co—Fe—Ni)_5$ alloys containing a sufficient amount of Fe to boost the energy product of the $Y(Co—Fe—Ni)_5$ magnet.

In accordance with inventive concepts described herein, a magnet includes a material having a chemical formula: $YFe_3(Ni_{1-x}Co_x)_2$, wherein x may be greater than 0 and x may be less than 1. In some approaches, the material may have a chemical formula: $YFe_3(Ni_{1-x}Co_x)_2$, where x may be greater than 1−x such that the compound has a greater amount of Co compared to Ni. Accordingly, x may be a value between 0.5 and 1, such as 0.51, 0.52 . . . 0.98, 0.99. In other approaches, the material may have a chemical formula: $YFe_3(Ni_{1-x}Co_x)_2$, where x may be less than 1−x, such that the compound has a greater amount of Ni compared to Co. Accordingly, x may be a value between 0 and 0.5, such as 0.01, 0.02 . . . 0.48, 0.49. Preferably, whether x is greater than or less than 1−x, the values are within a 10% difference of one another, e.g., x is a value in a range of 0.45-0.55. In preferred approaches, the material may have a chemical formula: $YFe_3(Ni_{1-x}Co_x)_2$, where x is about equal to 1−x.

In at least one contemplated approach, in addition to iron and nickel, copper may be used to dope the $YCo_5$ magnets as described herein. In contrast to the $Y(Co_{1-x}Fe_x)_5$ system, $Y(Co_{1-x}Ni_x)_5$ and $Y(Co_{1-x}Cu_x)_5$ compounds are stable across the composition domain comprising x=0 to 1. Substituting cobalt atoms with nickel and/or copper atoms gradually decreases magnetization and magnetic anisotropy.

Preferably, the magnet as described in the inventive concepts herein includes a lower (e.g., reduced) amount of cobalt (up to 75% less Co) than the amount of Co in $YCo_5$. Moreover, the magnet as described may be a permanent magnet.

The magnet compound of $YFe_3(Ni_{1-x}Co_x)_2$ material as described herein may have a $CaCu_5$-type crystal structure. Referring again to FIG. 1, the $YFe_3(Ni_{1-x}Co_x)_2$ may form a hexagonal $CaCu_5$-type structure 100: $Y_1$ in position 1a 102, Co atoms, Fe atoms, and Ni atoms sharing transition metal position 2c 104 sites and position 3g 106 non-equivalent atomic sites with 6 atoms per formula unit. In at least one exemplary aspect, Fe atoms occupy all 3g 106 positions of the $CaCu_5$-type structure and the $YFe_3(Ni_{1-x}Co_x)_2$ alloy remains thermodynamically stable until approximately all Ni atoms (which occupy all the 2c 104 positions) are substituted by Co atoms.

In the inventive concepts described herein, a thermodynamically stable permanent magnet, for example having the chemical formula $YFe_3(Ni_{0.5}Co_{0.5})_2$, may include no more than three Fe atoms per unit of the compound. Ideally, the Fe atoms would be distributed in the transition metal position 3g 106 nonequivalent atomic sites (as shown in FIG. 1) of the crystal structure 100.

According to inventive concepts described herein, the addition of Ni to $Y(Co_{1-x}Fe_x)_5$ magnets may stabilize the magnet. Transition metals have increasing 3d electron count in the following order: Fe<Co<Ni. Thus, replacing Co atoms with Fe atoms decreases the amount of 3d electrons in the compound, whereas replacing Co atoms with Ni atoms increases the amount of 3d electrons in the compound.

According to inventive concepts described herein, the resulting $YFe_3(Ni_{1-x}Co_x)_2$ magnet may have a large energy product. State of the art electronic structure calculations confirmed that addition of Ni to $YCo_5$ magnets stabilized $Y(Co_{1-x}Fe_x)_5$ and maintained a reasonably high MAE comparable with the MAE of $YCo_5$ magnets (see below in Experiments and Modeling Results).

According to inventive concepts described herein, a magnet with $YFe_3(Ni_{1-x}Co_x)_2$ material includes Fe atoms, Ni atoms and the Co atoms which may be distributed in transition metal 2c 104 nonequivalent atomic sites. Moreover, high axial MAE may be obtained with energetically stable $YFe_3(Ni_{1-x}Co_x)_2$ alloys using abundant and cost-effective Fe and Ni in place of expensive Co, and thereby achieving higher magnetic energy product compared to the $YCo_5$ prototype compound. Some approaches may include a $YFe_3(Ni_{1-x}Co_x)_2$ compound with partial ordering on the 2c-type 104 sites.

A magnet of $YFe_3(Ni_{1-x}Co_x)_2$ includes a spin orientation of the Y atom that may be antiparallel to a spin orientation of the Fe, Ni, and Co atoms. The spin properties of the electrons in an atom generate a magnetic moment of the atom, as measured in terms of Bohr magneton ($\mu_B$). Theoretical measurements of the $YFe_3(Ni_{1-x}Co_x)_2$ magnet show magnetic moments of Y to be opposite atoms of each of the transition metals (e.g., Co, as shown below in Table 1).

Permanent magnets preferably include material with a high magnetocrystalline anisotropy energy (MAE). The MAE is the very small energy difference between phases with spin moments oriented in the easy and hard directions. The MAE may be defined by appropriate representation of the electronic and magnetic structures. In terms of uniaxial anisotropy, the MAE constant $K_1>0$, where the MAE constant $K_1$ is expressed in $MJ/m^3$ units. The opposite case, $K_1<0$, corresponds to the planar anisotropy. The magnitude of the MAE constant, $K_1$, reflects the magnitude of MAE such that a larger positive value of $K_1$ constant corresponds to a larger uniaxial MAE.

A magnet of $YFe_3(Ni_{1-x}Co_x)_2$ may have a MAE that is about twice a MAE of $Nd_2Fe_{14}B$. In some approaches, a magnet of $YFe_3(Ni_{1-x}Co_x)_2$ has a magnetocrystalline anisotropy energy constant ($K_1$) that may be greater than about 10.6 $MJ/m^3$.

In some approaches, the $YFe_3(Ni_{1-x}Co_x)_2$ material may have a high MAE that may be comparable to the MAE of praseodymium ($PrCo_5$), samarium ($SmCo_5$), yttrium ($YCo_5$) magnets of 8.1 $MJ/m^3$, 17.2 $MJ/m^3$ and 6.5 $MJ/m^3$, respectively. The theoretical values of the $YFe_3(Ni_{1-x}Co_x)_2$ compounds described herein were derived using novel computational material science approaches (see below in Experiments and Modeling Results).

It is desirable for a magnet material to have a high Curie temperature ($T_c$) in order to continue to function as a magnet under conditions with elevated temperatures. According to inventive concepts described herein, the material of the magnet $YFe_3(Ni_{1-x}Co_x)_2$ has a Curie temperature ($T_c$) that may be about equal to a Curie Temperature of $YCo_5$. In some approaches, the material of the magnet $YFe_3(Ni_{1-x}Co_x)_2$ may have a $T_c$ greater than or equal to about 1000 K.

Moreover, the $YFe_3(Ni_{1-x}Co_x)_2$ compound may have a high magnetic energy product, comparable to neodymium-based magnets. The material of the magnet $YFe_3(Ni_{1-x}Co_x)_2$ may have a maximum energy product of the material greater than or equal to about 351 $kJ/m^3$. In one exemplary aspect, a $YFe_3CoNi$ magnet may have a maximum energy product of the material greater than about 309 $kJ/m^3$. In various aspects, a $YFe_3CoNi$ magnet may have a maximum energy product of the material greater than or equal to about 300 $kJ/m^3$.

In at least one exemplary aspect, a thermodynamically stable $YFe_3(Ni_{0.3}Co_{0.7})_2$ magnet may be created by substituting up to an additional 30 at. % Ni for Co having a $T_c$ of 900 K which is close to the calculated $T_c$ of $YCo_5$ magnet's $T_c$ of 892 K. The $YFe_3(Ni_{0.3}Co_{0.7})_2$ magnet may have a maximum energy product of the material greater than about 351 $kJ/m^3$.

In another exemplary aspect, a $YFe_3Co_2$ magnet may be created having a Curie temperature $T_c$ of 1098 K and a maximum energy product of 365 $kJ/m^3$, according to various aspects described herein. The foregoing maximum energy product is about 71% of the maximum energy product for $Nd_2Fe_{14}B$ magnets (e.g., 512 $kJ/m^3$).

There are potentially many ways to produce the magnets described here, as would be readily apparent to one skilled in the art after reading the present disclosure. Any such method may be used to present the novel materials described herein.

An illustrative method to form a permanent magnet, which is presented by way of example only, may include starting with a $YNi_5$ compound that is in a $CaCu_5$-type structure. A maximum amount of Fe metal (e.g., ~60 at %) may be dissolved with the $YNi_5$ compound to form a stable $YFe_3Ni_2$ compound in the same structure modification where iron atoms predominantly occupy 3g sites of the crystal structure. In an ideal crystal structure, Fe atoms occupy all 3g positions.

The formation method may subsequently include gradual alloying of the $YFe_3Ni_2$ compound with Co, while keeping the amount of Y and Fe constant. In a preferred embodiment, up to 92% of the Ni atoms may be replaced with Co atoms.

Experiments and Modeling Results $YCo_5$ compounds crystallize in the hexagonal $CaCu_5$-type structure with three non-equivalent atomic sites: $Y_1$-(1a) 102, $Co_1$-(2c) 104, and $Co_2$(3g) 106 (see FIG. 1) with six atoms per formula unit and per computational cell.

Earlier neutron-diffraction studies of the $Th(Co_{1-x}Fe_x)_5$ alloys (also based on the $CaCu_5$-type structure) show that the larger Fe atoms preoccupies the 3g-type 106 sites, whereas the smaller Co atoms choose to occupy the 2c-type 104 sites. This occupational inclination has been affirmed by DFT calculations for $YCo_5$ and $SmCo_5$ compounds. In line with these calculations, the total energy for Fe at the 3g 106 site ($E_{3g}$) is lower that than for Fe at the 2c 104 site ($E_{2c}$) by 0.21 eV/f.u. and 0.10 eV/f.u. for $YCo_5$ and $SmCo_5$ magnets, correspondingly. If the $YCo_5$ magnet is doped with Fe and Ni, Fe atoms occupy preferentially **3*g* 106 sites, while Ni atoms favor 2*c* 104** sites.

Figure 2B:
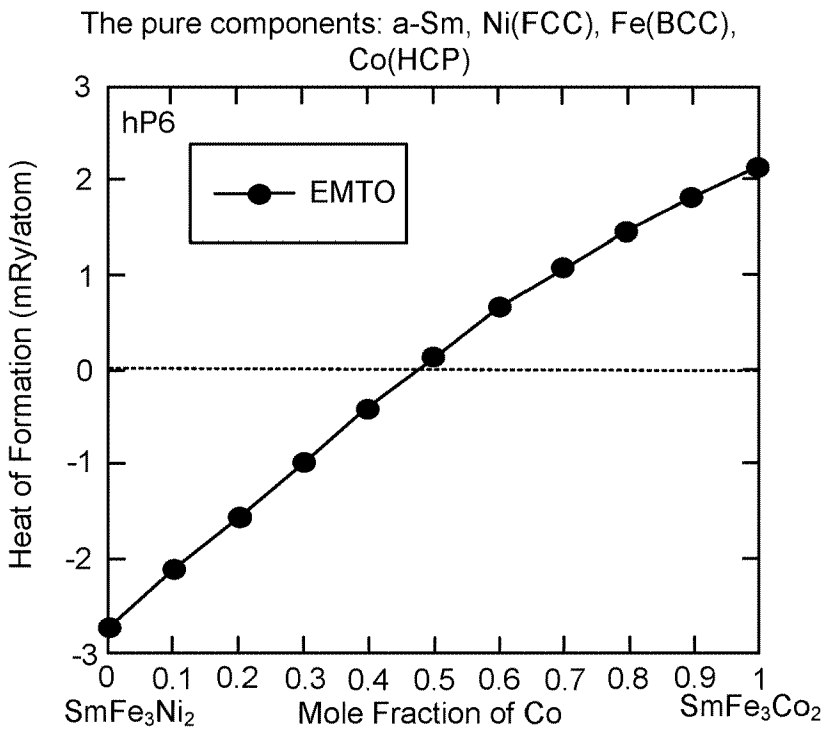
FIG. 2B depicts the heat of formation of the pseudo-binary $SmFe_3(Ni_{1-x}Co_x)_2$ alloys predicted via ab initio calculations, according to inventive concepts described.
Figure 2A:
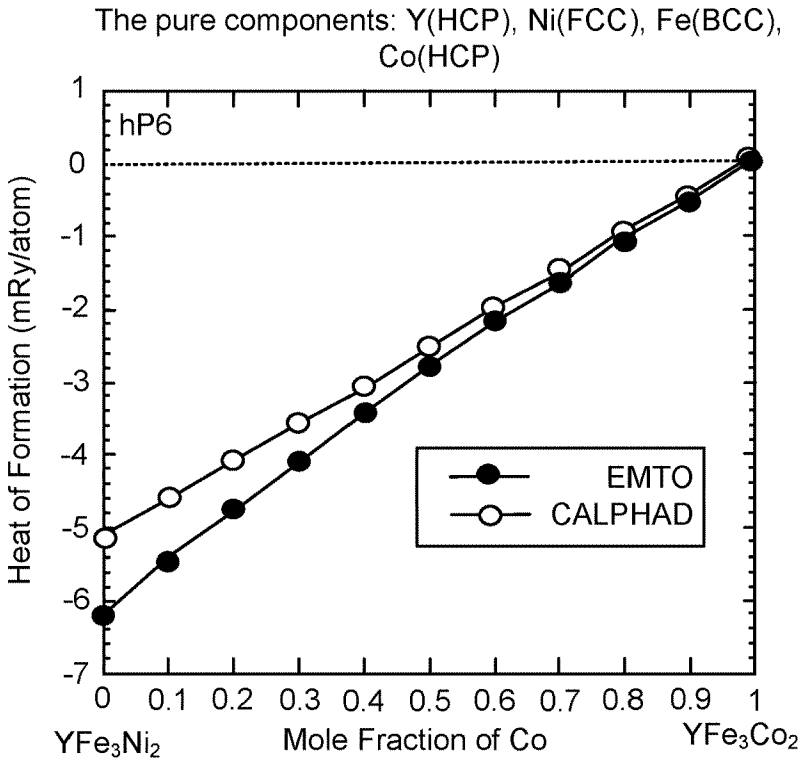
FIG. 2A depicts the heat of formation of the pseudo-binary $YFe_3(Ni_{1-x}Co_x)_2$ alloys predicted via ab initio (0K) and CALculation of PHAse Diagrams (CALPHAD) (298 K) calculations, according to inventive concepts described.

FIG. 2A depicts the heat of formation calculated within the EMTO-CPA technique of the pseudo-binary $YFe_3(Ni_{1-x}Co_x)_2$ alloys where Fe atoms occupy all 3g-type 106 sites, and the occupation of the 2c-type 104 sites continuously changes from pure Ni (the $YFe_3Ni_2$ compound) to pure Co (the $YFe_3Co_2$ compound). The current calculations show that the $YFe_3(Ni_{1-x}Co_x)_2$ alloys remain stable until almost all Ni atoms are replaced by Co atoms.

FIG. 2B depicts the heat of formation calculated within the EMTO-CPA formalism of the pseudo-binary $SmFe_3(Ni_{1-x}Co_x)_2$ alloys where Fe atoms occupy all 3g-type 106 sites, and the occupation of the 2c-type 104 sites continuously changes from pure Ni (the $SmFe_3Ni_2$ compound) to pure Co (the $SmFe_3Co_2$ compound). These calculations show that the pseudo-binary $SmFe_3(Ni_{1-x}Co_x)_2$ alloys could remain stable until almost half of Ni atoms are replaced by Co atoms.

Nickel metal forms the stable $CaCu_5$-type compounds with both yttrium and samarium metals. Calculated within EMTO formalism, the heat of formation of $SmNi_5$ and $YNi_5$ compounds (in the $CaCu_5$-type structure) is −18.95 mRy/atom and −22.91 mRy/atom, correspondingly, which is in accord with the experimental measurements of −23.08 mRy/atom (−30.3 kJ/mole, $SmNi_5$) and −25.98 mRy/atom (−34.1 kJ/mole, $YNi_5$). The $YFe_5$ compound as well as the $SmFe_5$ compound do not exist in the equilibrium Y—Fe and Sm—Fe phase diagrams, correspondingly, thus no experimental information about the heat of formation of these hypothetical compounds is available. However, the EMTO calculations show that the heat of formation of the $YFe_5$ compound is positive, +6.46 mRy/atom, and is half of the calculated heat of formation of the $SmFe_5$ compound, +12.68 mRy/atom. As a result, the calculated heat of formation of the $YFe_3Co_2$ compound, +0.09 mRy/atom, appears to be smaller than the calculated heat of formation of the $SmFe_3Co_2$ compound, +2.15 mRy/atom. The computed heats of formation of the $YFe_3Ni_2$ and the $SmFe_3Ni_2$ compounds are both negative (stable compounds), however, the absolute value of the calculated heat of formation of the $YFe_3Ni_2$ compound, |−6.20| mRy/atom, is more than twice as high as the absolute value of the heat of formation of the $SmFe_3Ni_2$ compound, |−2.72| mRy/atom. As a result, the region of stability of the pseudo-binary $YFe_3(Ni_{1-x}Co_x)_2$ alloys appears to be almost twice as wide as the region of stability of the pseudo-binary $SmFe_3(Ni_{1-x}Co_x)_2$ alloys.

Figure 3:
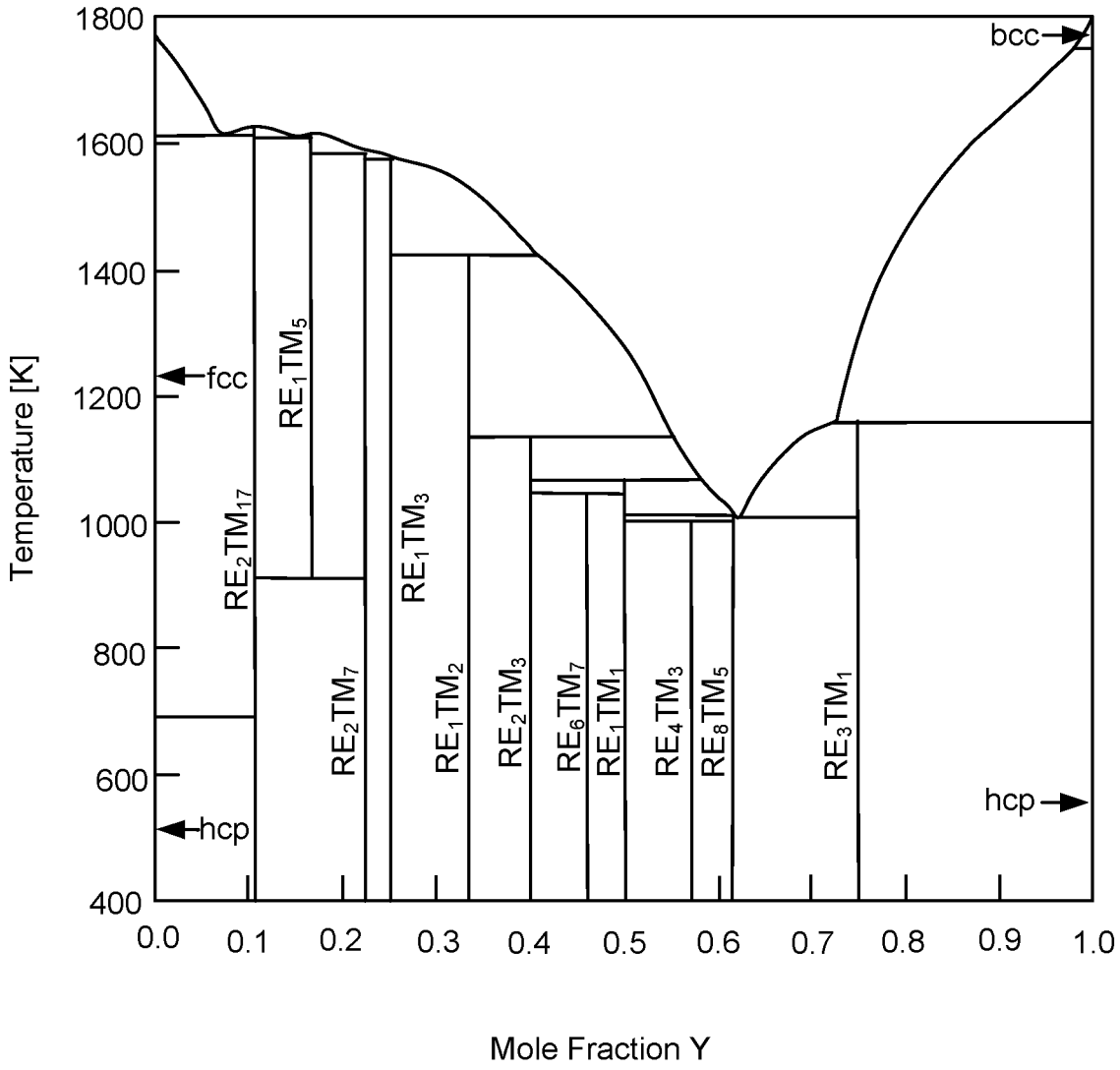
FIG. 3 depicts a Y—Co phase diagram calculated using the CALPHAD assessment where RE=Y and TM=Co, according to inventive concepts described.

FIG. 3 depicts a Y—Co phase diagram exhibiting agreement with experiments: (i) congruent melting of $Y_2Co_{17}$ and $YCo_5$ at 1630 K (exp.: 1630 K) and 1615 K (exp.: 1623 K), correspondingly; (ii) decomposition temperature of $YCo_5$ at 914 K (exp.: ~998 K); (iii) heat of formation of $YCo_5$ equal to '−12.46 kJ/mole and '−13.61 kJ/mole at 298 and 1000 K, correspondingly, compared with '−12.20±0.87 kJ/mole measured between 850 and 1200 K; (iv) heat of formation of $Y_2Co_{17}$ equal to '−8.74 kJ/mole and '−9.47 kJ/mole at 298 and 1000 K, correspondingly, compared with '−7.6±0.80 kJ/mole measured between 850 and 1200 K.

TABLE 1

Site-projected spin, $m^{(s)}$, and orbital $m^{(o)}$, magnetic moments for the $YCo_5$ compound FREMTO calculations. $m^{(tot)}$ = 7.82 $\mu_B$/f.u.

| Component | $Y_1$(1a) | $Co_1$(2c) | $Co_2$(3g) |
|---|---|---|---|
| $m^{(s)}$ ($\mu_B$) | +0.31 | −1.55 | −1.47 |
| $m^{(o)}$ ($\mu_B$) | −0.01 | −0.14 | −0.11 |

Y and Co spins align in an antiparallel fashion (AF) that is predicted in the present self-consistent calculations. The calculated total moment, $m^{(tot)}$=7.82$\mu_B$/f.u., is slightly smaller than the experimentally reported value of 8.30$\mu_B$/f.u. The calculated spin moments are 1.55$\mu_B$ and 1.47$\mu_B$ for 2c 104 and 3g 106 sites, correspondingly, which are larger than the recorded experimental values of 1.44$\mu_B$ and 1.31$\mu_B$. The calculated orbital moments are 0.14$\mu_B$ and 0.11$\mu_B$ for 2c 104 and 3g 106 sites, correspondingly, which are smaller than recorded experimental data of 0.26$\mu_B$ and 0.24$\mu_B$. The present FREMTO calculations reflect the experimental (spin flip-neuron scattering) observation; for the $YCo_5$ compound, the orbital moment of $Co_1$(2c) 104 atoms is bigger than the orbital moment of $Co_2$(3g) 106 atoms. The large MAE of the $YCo_5$ compound comes from a big orbital allowance from $Co_1$(2c) 104 sites, which are located in the same plane as $Y_1$(1a) 102 sites. Appropriately, $Co_1$(2c) 104 atoms have a big positive MAE allowance, while $Co_2$(3g) 106 atoms have a small negative MAE allowance. The axial (positive) MAE of the $YCo_5$ magnet can be achieved only if orbital moments on the $Co_1$(2c) 104 atoms are bigger than the orbital moments of the $Co_2$(3g) 106 atoms.

A mean-field treatment for the Curie temperature, $T_c$, can be formulated as:

$$T_c = \frac{2}{3} \times \frac{E_{tot}^{DLM} - E_{tot}^{AF}}{k_B}$$

where $$\left(\frac{E_{tot}^{DLM} - E_{tot}^{AF}}{k_B}\right)$$

is the difference among the ground state total energies of the DLM and the AF state, and $k_B$ is the Boltzmann constant. Principally, an assessment of the Curie temperature can be achieved from the total energy difference between the ferromagnetic (or antiferromagnetic) and the paramagnetic states. The difference between the total energies can be substituted by the difference between the effective single-particle (one atomic specie) energies, which are directly associated with AF and DLM states (the so-called mean-field treatment). In the present work, $E_{tot}^{DLM}$ and $E_{tot}^{AF}$ are calculated at the equilibrium volumes for DLM and AF states, correspondingly. According to the present EMTO-DLM and EMTO-AF calculations, $T_c$=891.8 K for the $YCo_5$ magnet, which is in good accord with the experimental data $T_c$=920 K, which is relatively larger than that of the commonly used $Nd_2Fe_{14}B$ magnet ($T_c$=588 K). Similar EMTO calculations reveal $T_c$=1149.3 K for the $YFe_5$ compound, although this compound does not exist in the Y—Fe phase diagram. There is an experimentally observed tendency of the Curie temperature to increase with Fe doping of the $YCo_5$ magnet, i.e., from $T_c$=930 K (the $YCo_5$ compound) to $T_c$=1020 K (the $Y(Co_{0.8}Fe_{0.2})_5$ compound).

Figure 4:
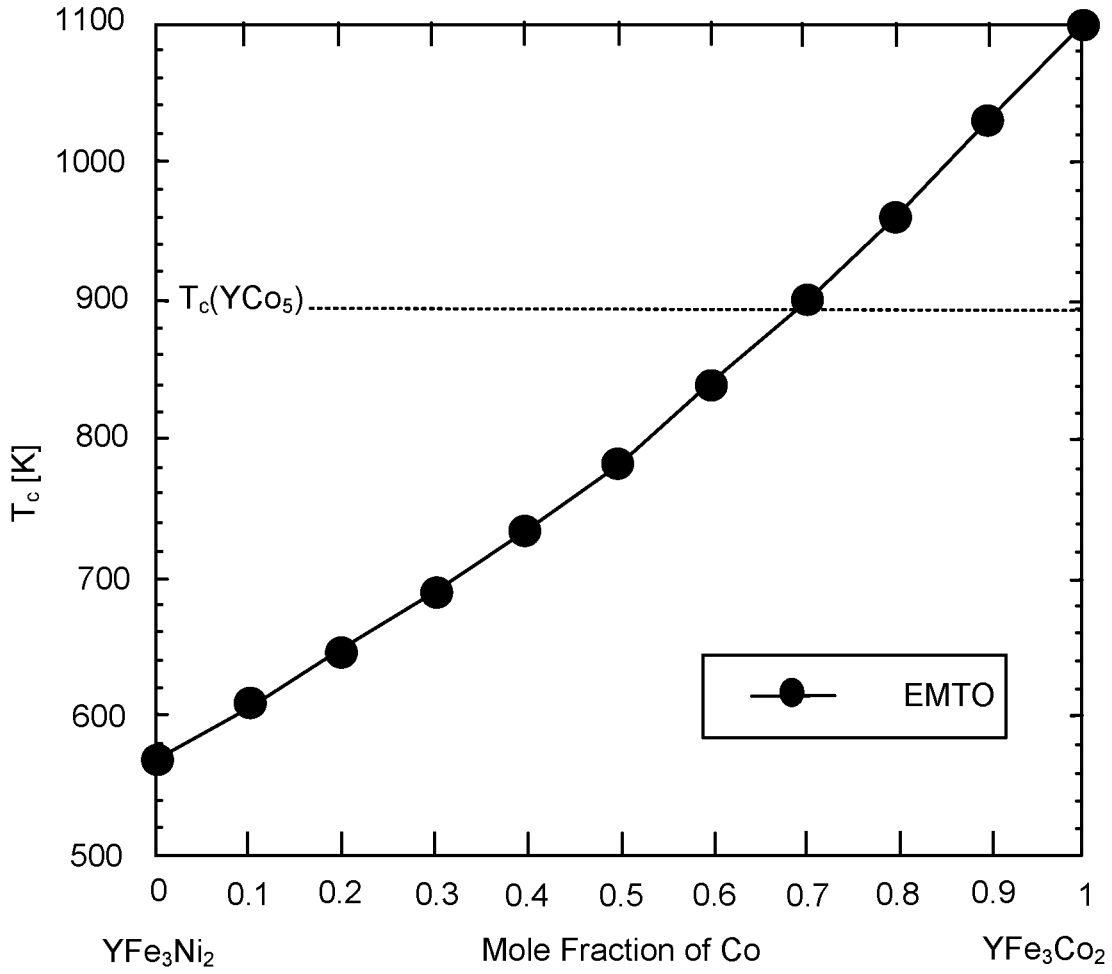
FIG. 4 depicts the Curie temperature of the pseudo-binary $YFe_3(Ni_{1-x}Co_x)_2$ alloys, according to inventive concepts described.

FIG. 4 depicts the Curie temperature calculated within the EMTO-CPA technique of the pseudo-binary $YFe_3(Ni_{1-x}Co_x)_2$ alloys where Fe atoms occupy all 3g-type 106 sites, and the occupation of the 2c-type 104 sites continuously changes from pure Ni (the $YFe_3Ni_2$ compound) to pure Co (the $YFe_3Co_2$ compound). The dotted line corresponds to the calculated Curie temperature of the $YCo_5$ magnet, $T_c$=891.8 K. The calculated Curie temperature is equal to 572.6 K and 1097.7 K for the $YFe_3Ni_2$ and $YFe_3Co_2$ magnets, correspondingly. Although the calculated Curie temperature of the $YFe_3Ni_2$ compound lies about 320 K below of the Curie temperature of the $YCo_5$ magnet, this deficiency can be removed by substituting 70 at. % of Ni by Co. The Curie temperature of the $YFe_3(Ni_{0.3}Co_{0.7})_2$ magnet is equal to 899.9 K.

According to the present calculations, the $YFe_3(Ni_{0.3}Co_{0.7})_2$ magnet shows an enormous total moment of $m^{(tot)}$~9.79$\mu_B$, essentially due to the iron atoms that each contribute with 2.45$\mu_B$. The total moment of the $YFe_3(Ni_{0.3}Co_{0.7})_2$ magnet is thus essentially bigger than that of the traditional $YCo_5$ magnet that has a calculated total moment of $m^{(tot)}$~7.82$\mu_B$. The experimental values of saturation magnetization ($M_s$) and the maximum energy product ($(BH)_{max}$) for the $YCo_5$ magnet are 0.85 MA/m and 224 kJ/m$^3$, correspondingly. Because saturation magnetization and magnetic moment are approximately proportional, $M_s \sim m^{(tot)}$, and the maximum energy product is approximately proportional to the square of the saturation magnetization, $(BH)_{max} \sim (M_s)^2$, one can evaluate that saturation magnetization for the $YFe_3(Ni_{0.3}Co_{0.7})_2$ magnet is proportional to 1.064 MA/m and the maximum energy product for the $YFe_3(Ni_{0.3}Co_{0.7})_2$ magnet should be approximately 351 kJ/m$^3$, which is ~69% of the record maximum energy product of the $Nd_2Fe_{14}B$ magnet, $(BH)_{max}$=512 kJ/m$^3$. Particularly, the $YFe_3(Ni_{0.3}Co_{0.7})_2$ magnet, which has a Curie temperature similar to the $YCo_5$ magnet, is a substantially steadier magnet than the $YCo_5$ magnet (its maximum energy product should be ~57% larger).

The magnetic anisotropy energy (MAE) is one of the more important properties of an efficient magnet. In the quest to increase the saturation magnetic moment or energy product, by substituting cobalt for iron, the impact of the doping on the MAE is reviewed.

TABLE 2

Calculated MAEs for the $YCo_5$-type magnets alloyed with iron, nickel, or both.

| | Unit Cell Vol. (Å$^3$) | | c/a Ratio | | $K_1$ (meV/cell) | | $K_1$ (MJ/m$^3$) | |
|---|---|---|---|---|---|---|---|---|
| Material | GGA | LDA | GGA | LDA | GGA | LDA | GGA | LDA |
| $YFe_5$ | 84.84 | 77.46 | 0.79 | 0.79 | 0.51 | 1.17 | 0.96 | 2.42 |
| $YCo_5$ | 82.65 | 76.38 | 0.80 | 0.80 | 9.89 | 6.44 | 19.17 | 13.51 |
| $YNi_5$ | 81.96 | 74.94 | 0.81 | 0.81 | 1.40 | 0.48 | 2.74 | 1.03 |
| $YeFe_3Co_2$ | 86.40 | 77.28 | 0.79 | 0.79 | 2.01 | 6.71 | 3.73 | 13.91 |
| $YeFe_3CoNi$ | 86.22 | 76.38 | 0.81 | 0.82 | 4.51 | 5.04 | 8.38 | 10.57 |
| $YeFe_3Ni_2$ | 86.34 | 76.64 | 0.84 | 0.83 | 1.93 | 3.69 | 3.58 | 7.69 |

For the $YFe_3Co_2$ and the $YFe_3CoNi$ magnets, the iron atoms are kept on the energetically favorably 3g 106 sites. In the case of $YFe_3CoNi$, Co and Ni are modeled as on the 2c 104 sites as two average atoms consistent with modeling of $SmFe_3CoNi$. In all calculations, the atomic volume is relaxed and the c/a axial ratio of the hexagonal phase. Some sensitivity is found (not shown) of the MAE to the axial ratios, suggesting that the structural relaxation is important.

According to the values calculated in Table 2, both $YFe_5$ and $YNi_5$ have relatively small magnetic anisotropy and, for that reason alone, they are not particularly strong magnets. $YFe_5$ is included in the table to provide context to the other magnets, as it does not exist in the hexagonal phase. $YCo_5$ contrarily exists and is predicted to have significant magnetic anisotropy. DFT-GGA calculations are relied on for these magnetic compounds because GGA performs better for the magnetic 3d transition metals relative to the LDA or even more modern approximations. GGA reproduces the proper magnetic ground state of iron, as opposed to the LDA. The GGA calculations reproduce the experimental atomic volume very well but overestimate the MAE for $YCo_5$ relative to experimental data. DFT-GGA (T=0 K) gives the unit cell volume $V_{cell}$=82.65 Å$^3$ and anisotropy $K_1$=9.89 meV/cell (19.2 MJ/m$^3$). These numbers are compared to experimental data at T=4.1 K, $V_{cell}$=82.50 Å$^3$, $K_1$=3.80 meV/cell (7.38 MJ/m$^3$) and at T=293 K, $V_{cell}$=83.99 Å$^3$, $K_1$=3.04 meV/cell (5.80 MJ/m$^3$). Here, the unit cell volume at T=4.1 K, $V_{cell}$=82.50 Å$^3$ is identified using the experimental value of the MAE coefficient, $K_1$, presented in the units of (MJ/m$^3$), and (meV/cell).

Replacing most of Co with Fe in the $YCo_5$ magnet and using Ni as a thermodynamic mediator results in an $YFe_3CoNi$ magnet with desired magnetic properties such as a very high Curie temperature, robust magnetic anisotropy, and a relatively large maximum energy product. $YFe_3CoNi$ magnets use nickel metal as the stabilizing material in the $YCo_5$ magnet in order to accommodate the maximum amount of iron metal to favor a very high magnetization.

For $YFe_3(Ni_{1-x}Co_x)_2$ alloys, it is possible to have stable solutions until approximately all Ni atoms are substituted by Co atoms. The ab initio heat of formation predictions are confirmed by CALPHAD modeling at 298 K. The combination of negative heat of formation and extended solubility limits experimentally observed in the $YTM_5$ (TM=Co, Fe, Ni) magnets (e.g., complete solubility from $YCo_5$ to $YNi_5$ at 1073 K and 1273 K; solubility of ~20 at. % Fe in $Y(Co,Fe)_5$ at 1323 K; solubility of ~30 at. % Fe in $Y(Fe,Ni)_5$ at 873 K) is promising for synthesis of the foregoing magnets. A specific example includes a $YFe_3Co_2$ magnet for which the calculated the Curie temperature, $T_c$, which is equal to 1097.7 K and the maximum energy product, $(BH)_{max}$ ($YFe_3Co_2$), as ~365 kJ/m$^3$, which is ~71% of the record maximum energy product of the $Nd_2Fe_{14}B$ magnet, $(BH)_{max}$=512 kJ/m$^3$. Here, the maximum energy products of $YFe_3Co_2$ and $YFe_3CoNi$ magnets are estimated using the calculated total magnetic moments of $YFe_3Co_2$, $YFe_3CoNi$, and $YCo_5$ magnets as well as the experimental values of the saturated magnetization and the maximum energy product of the $YCo_5$ magnet. Calculations are performed in the same fashion as for the $YFe_3(Ni_{0.3}Co_{0.7})_2$ magnet.

According to the presently disclosed calculations, the $YFe_3(Ni_{0.3}Co_{0.7})_2$ magnet has a Curie temperature $T_c$~900 K that is relatively close to the calculated Curie temperature of the $YCo_5$ magnet, $T_c$~ 892 K. In addition, the maximum energy product of the $YFe_3(Ni_{0.3}Co_{0.7})_2$ magnet is significantly improved compared to the $YCo_5$ magnet (~57% larger). The calculated intrinsic properties of the magnets are reported in Table 3 in conjunction with the experimental data of $Nd_2Fe_{14}B$, $SmCo_5$, and $YCo_5$ magnets for comparison. All four suggested permanent magnets have a Curie temperature significantly higher than that of $Nd_2Fe_{14}B$, $T_c$~ 588 K, spanning from 785 K to 1103 K. In addition, their maximum energy products are significantly higher than that of the commercially used $SmCo_5$ and $YCo_5$ magnets (231 $kJ/m^3$ and 224 $kJ/m^3$, respectively), reaching a maximum value of 365 $kJ/m^3$ for $YFe_3Co_2$. Our calculated (Table 3, LDA) MAEs for $YFe_3CoNi$ magnet is not much smaller than that of $YCo_5$ magnet (10.6 $MJ/m^3$ and 13.5 $MJ/m^3$, respectively).

TABLE 3

Intrinsic magnetic properties of $Nd_2Fe_{14}B$, $SmCo_5$, and $YCo_5$ permanent magnets (experiment) and $SmFe_3CoNi$, $YFe_3CoNi$, ($K_1$, LDA), $YFe_3(Ni_{0.3}Co_{0.7})_2$, and $YFe_3Co_2$ permanent magnets (theory).

| Material | $M_s$, (MA/m) | $T_c$ (K) | $K_1$ ($MJ/m^3$) | $(BH)_{max}$ ($kJ/m^3$) |
|---|---|---|---|---|
| $Nd_2Fe_{14}B$ | 1.28 | 588 | 4.9 | 512 |
| $SmCo_5$ | 0.86 | 1020 | 17.2 | 231 |
| $YCo_5$ | 0.85 | 987 | 6.5 | 224 |
| $SmFe_3CoNi$ | 1.08 | 1103 | 9.2 | 361 |
| $YFe_3CoNi$ | 1.00 | 785 | 10.6 | 309 |
| $YFe_3(Ni_{0.3}Co_{0.7})_2$ | 1.06 | 900 | | 351 |
| $YFe_3Co_2$ | 1.14 | 1098 | | 365 |

In Use

Considering $SmFe_3CoNi$ and $YFe_3CoNi$ magnets comprise up to 80% less Co than their $SmCo_5$ and $YCo_5$ precursors, maturing of these magnets becomes even more captivating from the current economic viewpoint. Replacing part of cobalt with iron in $SmCo_5$ and $YCo_5$ magnets stabilized with a small portion of nickel results in permanent magnets having many desirable characteristics. These permanent magnets are anticipated to have outstanding magnetic properties, a large maximum energy product, a strong magnetic anisotropy, and an exceptionally high Curie temperature.

In use, the alloy formulations described herein may be useful as permanent magnets with high MAE and energy product, and useful for high-temperature applications (e.g., Curie temperatures in a range of about 900 K to about 1100 K). The $YCoNiFe_3$ and $SmCoNiFe_3$ alloy formulations described herein may be used for cost-effective clean energy products, turbines, electric car battery applications, etc.

The inventive concepts disclosed herein have been presented by way of example to illustrate the myriad features thereof in a plurality of illustrative scenarios, embodiments, and/or implementations. It should be appreciated that the concepts generally disclosed are to be considered as modular, and may be implemented in any combination, permutation, or synthesis thereof. In addition, any modification, alteration, or equivalent of the presently disclosed features, functions, and concepts that would be appreciated by a person having ordinary skill in the art upon reading the instant descriptions should also be considered within the scope of this disclosure.

While various embodiments have been described above, it should be understood that they have been presented by way of example only, and not limitation. Thus, the breadth and scope of an embodiment of the present invention should not be limited by any of the above-described exemplary embodiments, but should be defined only in accordance with the following claims and their equivalents.

What is claimed is:

1. A magnet, comprising:

a material having a chemical formula: $YFe_3(Ni_{1-x}Co_x)_2$, wherein x is greater than 0 and x is less than 1, wherein a maximum energy product of the material is greater than about 351 $kJ/m^3$.

2. A magnet as recited in claim 1, wherein x is greater than 1−x.

3. A magnet as recited in claim 1, wherein x is less than 1−x.

4. A magnet as recited in claim 1, wherein x is about equal to 1−x.

5. A magnet as recited in claim 1, wherein the magnet is a permanent magnet.

6. A magnet as recited in claim 1, wherein a spin orientation of the Y atom is antiparallel to a spin orientation of the Fe, Ni, and Co atoms.

7. A magnet as recited in claim 1, wherein a magnetocrystalline anisotropy energy of the material is about twice a magnetocrystalline anisotropy energy of $Nd_2Fe_{14}B$ magnet.

8. A magnet as recited in claim 1, wherein a magnetocrystalline anisotropy energy of the material is greater than about 10 $MJ/m^3$.

9. A magnet as recited in claim 1, wherein a Curie Temperature of the material is about equal to a Curie Temperature of $YCo_5$.

10. A magnet as recited in claim 1, wherein a Curie Temperature of the material is greater than about 1000 K.

11. A magnet as recited in claim 1, wherein the amount of Co in the magnet is up to 80 at. % less Co than the amount of Co in $YCo_5$.

12. A magnet, comprising:

a material having a chemical formula: $YFe_3(Ni_{1-x}Co_x)_2$, wherein x is greater than 0 and x is less than 1, wherein the material has a $CaCu_5$-type crystal structure, wherein the Fe atoms are distributed in a plurality of transition metal 3g nonequivalent atomic sites, wherein a maximum energy product of the material is greater than about 351 $kJ/m^3$.

13. A magnet as recited in claim 12, wherein the Ni atoms and the Co atoms are distributed in a plurality of transition metal 2c nonequivalent atomic sites.

14. A magnet, comprising:

a material having a chemical formula: $YFe_3(Ni_{1-x}Co_x)_2$, wherein x is greater than 0 and x is less than 1, wherein the material has a $CaCu_5$-type crystal structure, wherein the Ni atoms and the Co atoms are distributed in a plurality of transition metal 2c nonequivalent atomic sites, wherein a maximum energy product of the material is greater than about 351 $kJ/m^3$.

15. A magnet as recited in claim 14, wherein x is about equal to 1−x.

16. A magnet as recited in claim 14, wherein the Fe atoms are distributed in a plurality of transition metal 3g nonequivalent atomic sites, wherein a maximum energy product of the material is greater than about 351 $kJ/m^3$.

17. A magnet as recited in claim 14, wherein x is greater than 1−x.

* * * * *